US005647110A

United States Patent [19]

Ritter et al.

[11] Patent Number: 5,647,110

[45] Date of Patent: Jul. 15, 1997

[54] SYSTEM FOR THE CONTINUOUS PRODUCTION OF BUILDING ELEMENTS

[75] Inventors: Klaus Ritter; Gerhard Ritter; Gerhard Schmidt, all of Graz, Austria

[73] Assignee: EVG Entwicklungs- u. Verwertungs-Gesellschaft mbH, Raaba, Austria

[21] Appl. No.: 617,857

[22] PCT Filed: Feb. 13, 1995

[86] PCT No.: PCT/AT95/00032

§ 371 Date: Mar. 14, 1996

§ 102(e) Date: Mar. 14, 1996

[87] PCT Pub. No.: WO96/03234

PCT Pub. Date: Feb. 8, 1996

[30] Foreign Application Priority Data

Jul. 28, 1994 [AT] Austria ..... 1495/94

[51] Int. Cl.[6] ..... B23P 21/00; B23K 11/11; B21F 27/10; B21F 15/08

[52] U.S. Cl. ..... 29/33 K; 140/112; 219/56; 228/173.5

[58] Field of Search ..... 29/33 K, 33 P, 29/33 Q, 460, 794, 564.8, 446; 140/112; 52/309.12; 219/56, 57, 58; 228/4.1, 173.5

[56] References Cited

U.S. PATENT DOCUMENTS

| | | | |
|---|---|---|---|
| 4,372,350 | 2/1983 | Schmidt et al. | 228/173.5 X |
| 5,053,597 | 10/1991 | Ritter et al. | 219/56 |
| 5,102,027 | 4/1992 | Se Hong | 228/4.1 |
| 5,113,915 | 5/1992 | Ritter et al. | 140/112 |
| 5,403,985 | 4/1995 | Ahn | 219/56 |
| 5,446,254 | 8/1995 | Ritter et al. | 140/112 X |

FOREIGN PATENT DOCUMENTS

| | | | |
|---|---|---|---|
| 372 886 | 11/1983 | Austria | 29/446 |
| 0 069 108 | 1/1983 | European Pat. Off. | 219/56 |
| 0 094 809 | 11/1983 | European Pat. Off. | 29/564.8 |
| 2 177 030 | 11/1973 | France . | |
| 2 336 994 | 7/1977 | France . | |
| 33 06 954 | 9/1983 | Germany . | |

*Primary Examiner*—William R. Briggs
*Attorney, Agent, or Firm*—Frishauf, Holtz, Goodman, Langer & Chick, P.C.

[57] ABSTRACT

Plant for the continuous production of building elements which consist of two parallel flat grid meshes made from welded longitudinal and transverse wires, of straight web wires holding the grid meshes at a predetermined mutual spacing and of an insulating body which is arranged between the grid meshes and through which the web wires penetrate, with a production channel (2), on both sides of which supply reels (3, 3') and straightening devices (5, 5'), each for an endless grid sheet (G, G') standing on edge, and push-in devices (7, 7') are provided for drawing off the grid sheets in steps and for introducing these into grid-sheet lead devices (14, 14'), two cutting devices (11, 11') for severing grid meshes (M, M') of predetermined length being arranged upstream of the lead devices, and the grid meshes being capable of being advanced in the lead devices and in the production channel in steps to web-wire feeding and cutting devices (26, 26') by means of a grid-mesh conveying device (18) and downstream welding devices (30, 30') being capable of being advanced for the simultaneous welding of the two ends of all the web wires (S) to corresponding longitudinal wires (L, L') of the grid meshes, furthermore an insulating-body guide device (22) and an insulating-body conveying device (24) being provided for advancing the insulating bodies in steps, synchronously with the grid meshes and a building-element conveying device (32) being provided for conveying the building elements in steps to web-wire trimming devices (35, 35') and for conveying the building elements out of the production channel, and the push-in devices and all the conveying devices, coupled to one another, being capable of being driven jointly by means of drive shafts (38, 38').

31 Claims, 7 Drawing Sheets

SYSTEM FOR THE CONTINUOUS PRODUCTION OF BUILDING ELEMENTS

The invention relates to a plant for the continuous production of building elements which consist of two parallel flat grid meshes made from intersecting longitudinal and transverse wires welded to one another at the intersection points, of straight web wires holding the grid meshes at a predetermined mutual spacing and of an insulating body which is arranged between the grid meshes and through which the web wires penetrate, with a production channel, with two supply reels, arranged on both sides of the production channel, and downstream straightening devices, each for a grid sheet, with two curved lead devices opening tangentially on opposite longitudinal sides of the production channel, with an insulating-body guide device arranged between the two lead devices, with at least one group, arranged laterally of the production channel, of web-wire supply reels and web-wire feeding and cutting devices, with web-wire welding devices which are arranged on both sides of the production channel and which have a transformer and flexible electrical leads from the secondary outputs of the transformer to jaws of welding tongs pivotable into the grid-mesh planes, and with web-wire trimming devices, each for severing a projecting length of web wire.

A plant of this generic type is known from Austrian Patent Specification 372,868. In this plant, first of all, two grid sheets are brought into a parallel position at a mutual spacing corresponding to the desired thickness of the building element to be produced. An insulating board is inserted into the interspace between the grid sheets and with a spacing from each grid sheet. A plurality of web wires are guided in vertical rows one above the other from the side, from wire-supply reels, through one of the two grid sheets into the interspace between the grid sheets and through the insulating board, in such a way that each web wire comes to rest with each of its ends near one grid wire of the two grid sheets. The front ends of the web wires are welded to the corresponding grid wires of the one grid sheet and the web wires are severed from the wire supply. In a subsequent work step, in a further web-wire welding device the severed ends of the web wires are welded to the corresponding grid wires of the other grid sheet.

The welding devices used in the known plant consist essentially of a transformer, of flexible electrical leads, connecting the secondary outputs of the transformer to electrode holders and of electrodes. The electrode holders form jaws of welding tongs and are pivotable into the grid-mesh plane. In a subsequent work step, the laterally protruding projecting lengths of the web-wire ends are severed by the pivotably mounted trimming shears. One jaw of each trimming shear serves as an abutment for a grid wire of the grid meshes of the element, whilst the other jaw of each trimming shear acts as a knife which shears off the projecting length of web wire in each case in the direction of the grid wire retained by the jaw. Finally, building elements of appropriate length are separated.

A disadvantage of the known plant is that only a joint change of the shoot-in angles of the two rows of web wires is possible, and that an additional welding station is necessary in the case of large spacings between adjacent rows of web wires in the shoot-in region of the web wires. Another disadvantage is that work is carried out with individual independent electrode holders and that a particular trimming shear is required for each projecting length of web wire, whilst all the electrode holders and all the trimming shears have to be activated separately. A further disadvantage is, finally, that the cutting devices for severing the grid sheets of the already finished building element involve an extremely high outlay.

The object of the invention is to provide a plant of a type specified in the introduction, which avoids the disadvantages of the known plant and which, moreover, makes it possible, in a continuous production operation, to produce building elements with different arrangements of web wires and rows of web wires in the building element and with various types of grid meshes. The object of the invention is, furthermore, to provide a plant which makes it possible, in one welding operation, to weld the ends of all the web wires of a row simultaneously to the longitudinal wires of at least one grid mesh and to sever a plurality of projecting lengths of web wire simultaneously in one cutting operation.

The plant according to the invention is characterized in that a push-in device for drawing off in steps an endless grid sheet standing on edge from at least one supply reel, and for introducing the grid sheet into the lead devices is arranged on each of the two sides of the production channel, in that two cutting devices for severing grid meshes of predetermined length from the endless grid sheets are provided upstream of the lead devices, the grid meshes being capable of being advanced in steps in the lead devices and in the production channel by means of a grid-mesh conveying device, in that an insulating-body conveying device extending over the insulating-body guide device and the production channel is provided for advancing in steps, synchronously with the grid meshes, at least partially dimensionally stable insulating bodies intended for fixing the web wires, in that the feeding and cutting devices for equipping the insulating body with web wires and downstream welding devices for the simultaneous welding of the two ends of all the web wires to corresponding longitudinal wires of the grid meshes are provided in the effective range of the grid-mesh conveying device, in that, by means of a building-element conveying device, the building elements can in steps and successively be fed to the web-wire trimming devices and be conveyed out of the production channel, and in that the push-in devices and all the conveying devices, coupled to one another, can be driven jointly by means of drive shafts.

This construction makes it possible with high operating reliability and economically to obtain the continuous production of building elements of differing design, that is to say a highly flexible mode of operation.

According to a preferred embodiment of the invention, a delivery device is provided for the at least single-track feed of insulating bodies cut to length and/or of an endless insulating-body sheet into the guide device and a cutting device for severing insulating bodies of predetermined length from the insulating-body sheet is provided in the exit region of the guide device.

According to a further feature of the invention, provision is made for the grid-mesh conveying device and the building-element conveying device each to have at least two pairs of advancing elements or conveying elements, the individual elements of all the pairs being located opposite one another on both sides of the production channel. At the same time, preferably, each advancing element, each conveying element and each grid-sheet push-in device has a shaft inclined relative to the vertical direction and possessing at least two transport discs provided with a plurality of grid-engagement recesses.

According to the invention, the web-wire feeding and cutting devices are pivotable in order to vary the shoot-in angles of the web wires.

A development of the invention has the features that there is provided for each side face of the building element to be produced at least one welding device provided with a plurality of welding tongs, for the simultaneous welding of, in each case, one end of a plurality of straight web wires, arranged one above the other at a mutual spacing in at least one row, to the horizontally extending longitudinal wires of a grid mesh, the welding tongs being designed as two-armed pivotable lower and upper welding-tong levers which cooperate in pairs and of which the ends facing the grid meshes and pivotable into the grid-mesh planes have welding electrodes for welding at least one web wire to one longitudinal wire of the grid mesh.

Further features and advantages of the invention are explained in more detail below by means of exemplary embodiments with reference to the drawings. In these:

Figure 3A:
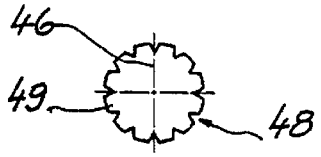
Figure 3B:
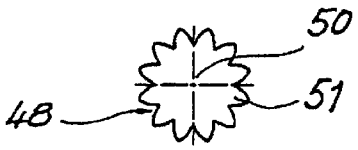
Figure 4:
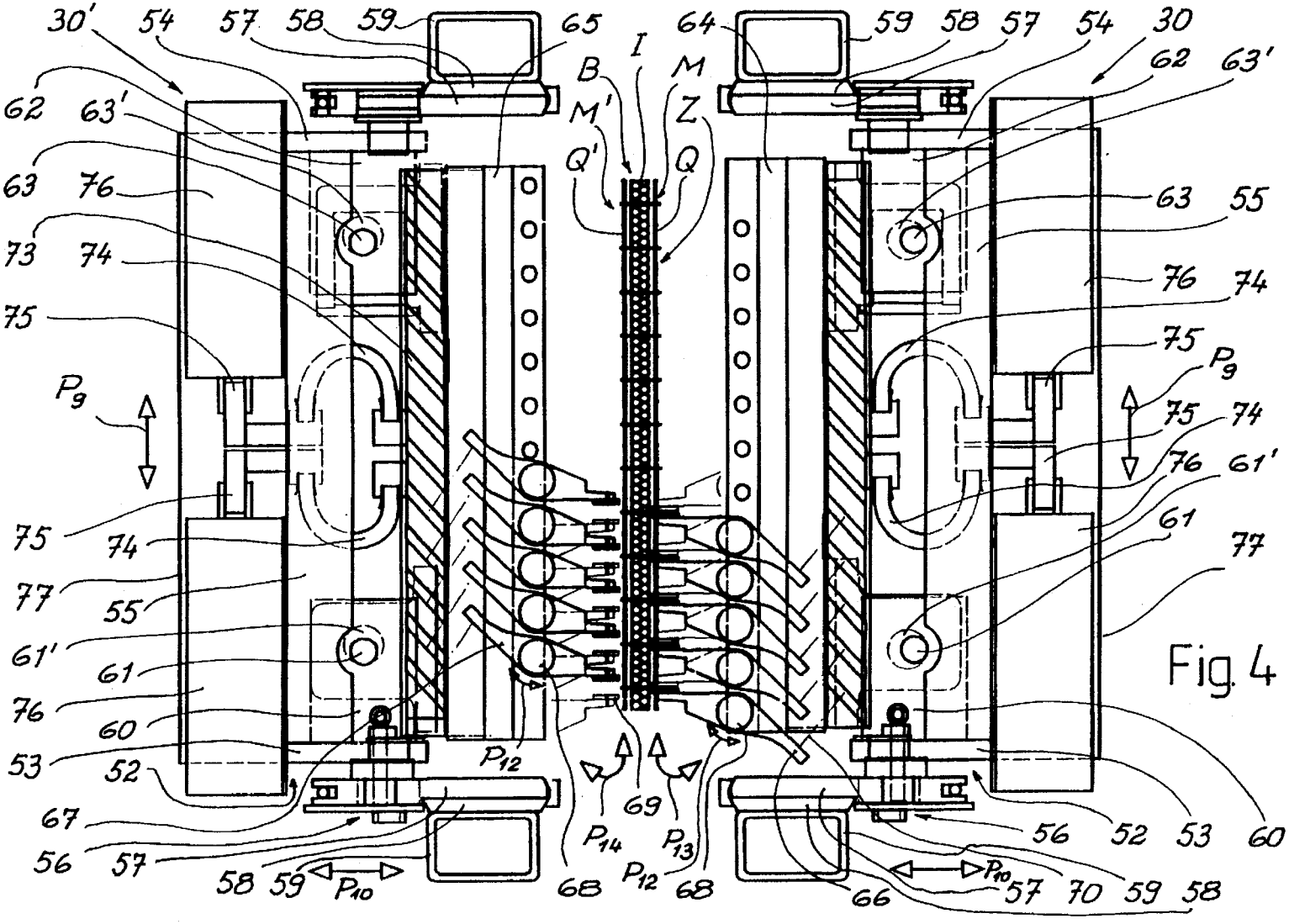
Figure 5:
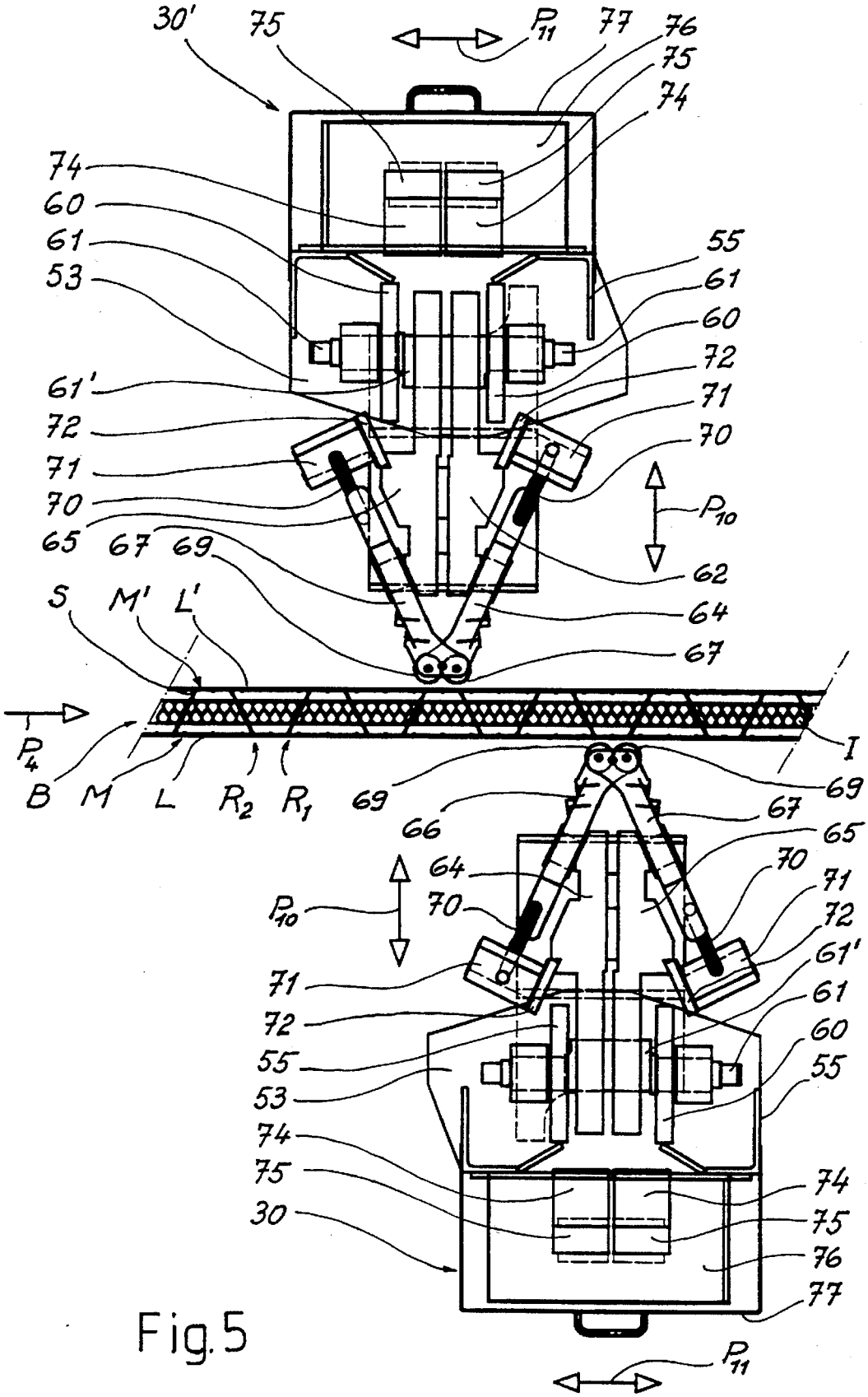
Figure 6:
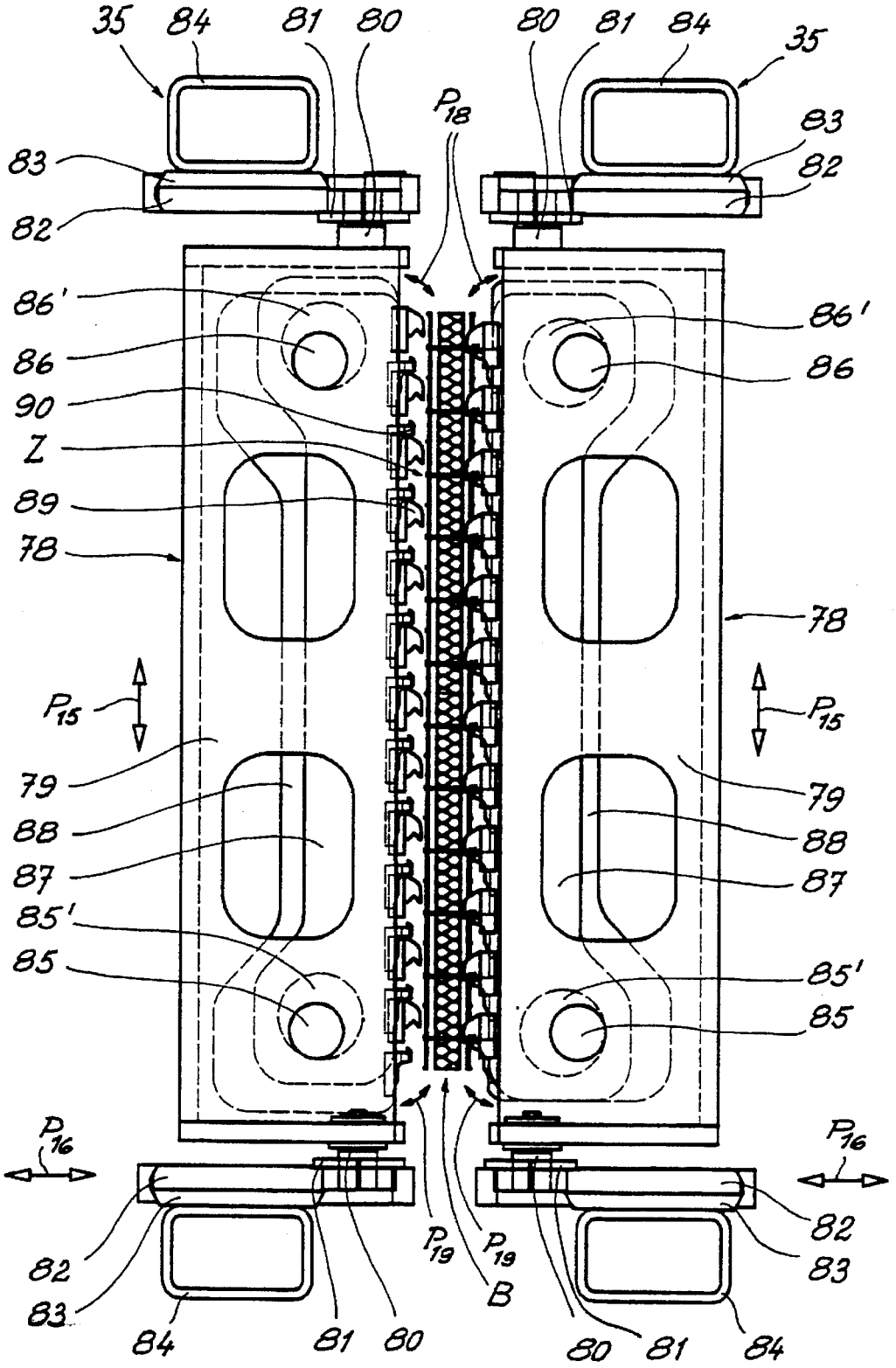
Figure 7:
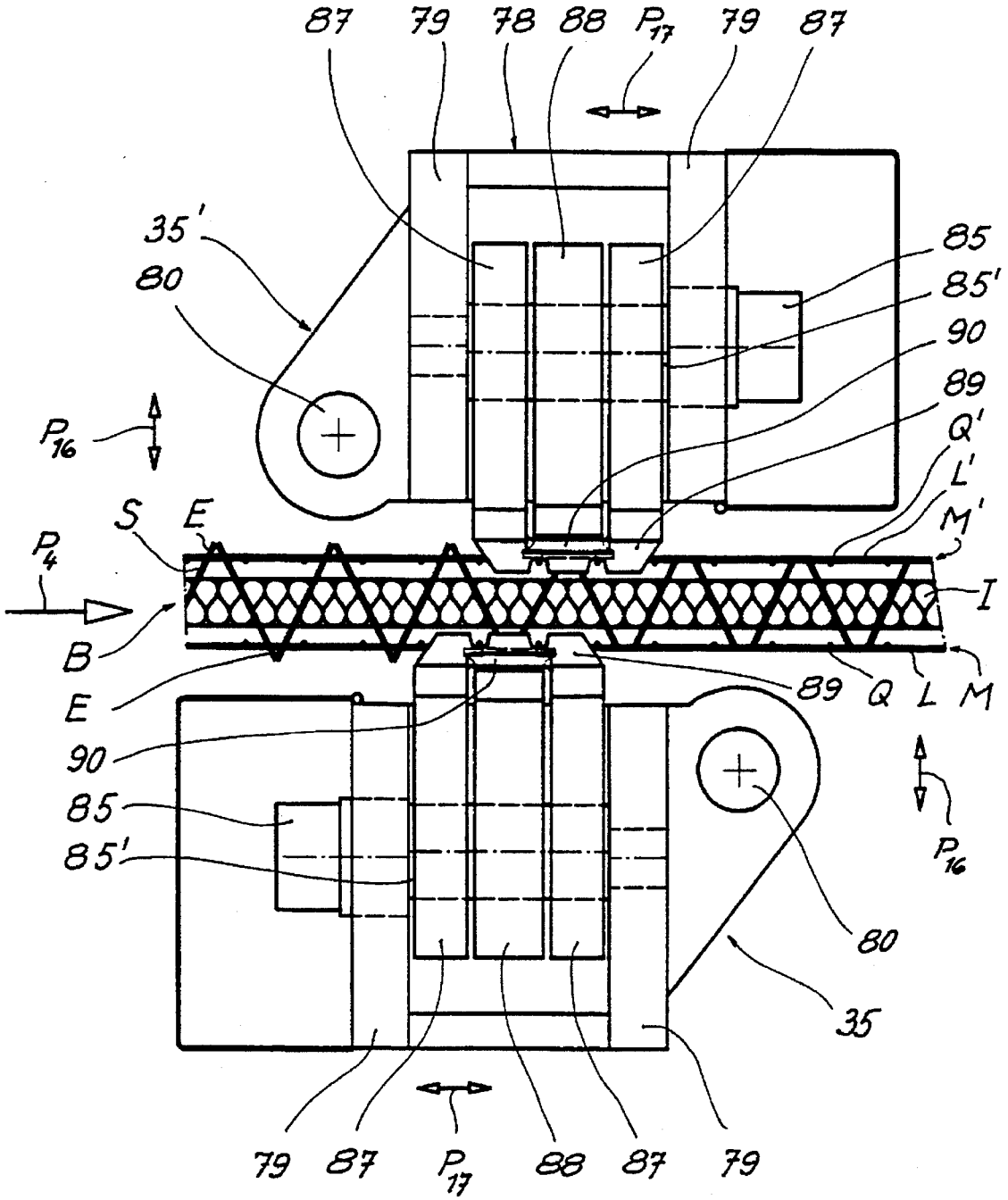
Figure 8:
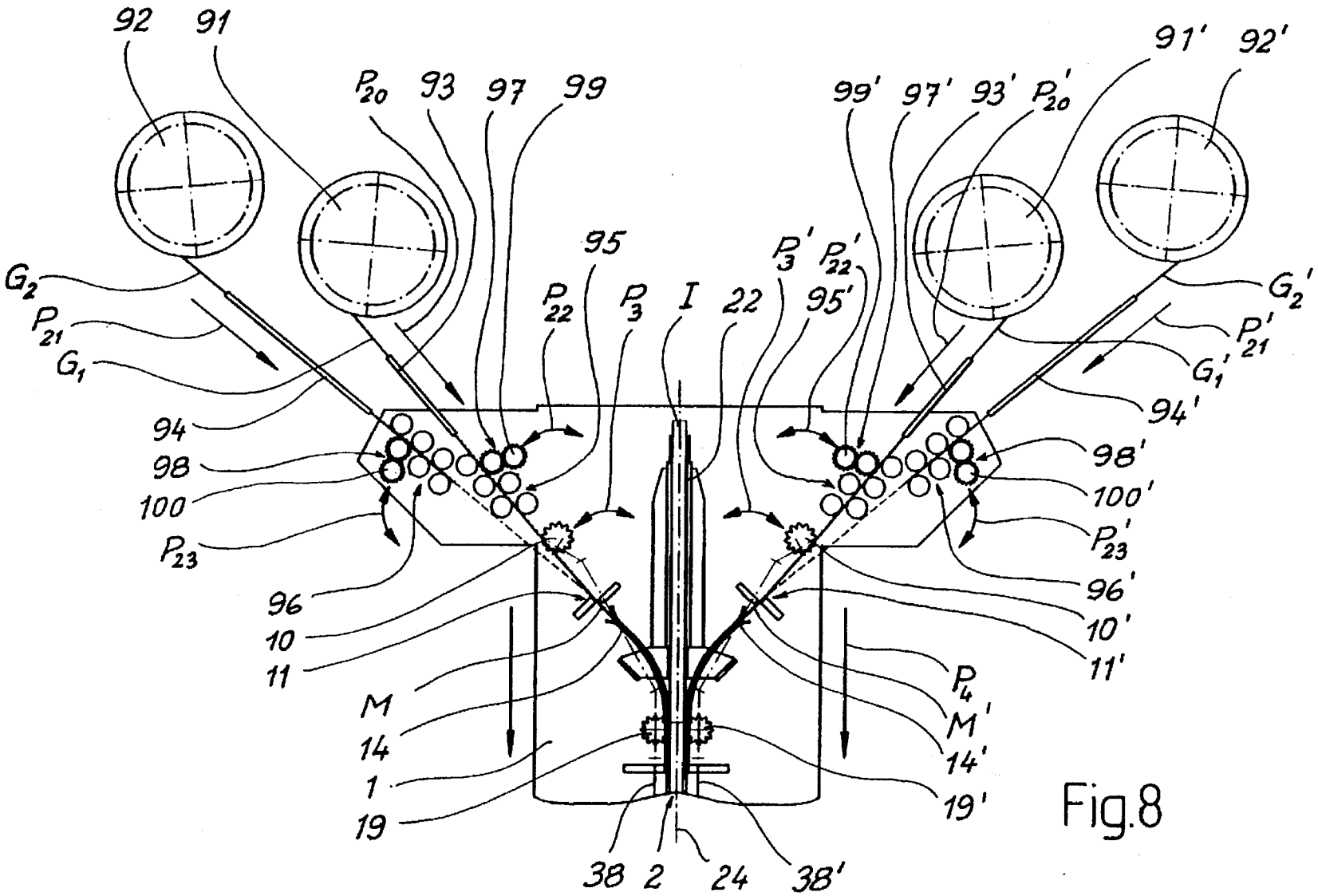

FIGS. 3*a* and 3*b* show different types of transport discs;

FIG. 4 shows a diagrammatic vertical section through a web-wire welding device of the plant according to the invention, the welding device represented in the left-hand half of the drawing being shown in its initial position and the welding device represented in the right-hand half of the drawing being shown in its welding position;

FIG. 5 shows a diagrammatic horizontal section through the web-wire welding device;

FIG. 6 shows a diagrammatic vertical section through trimming devices of the plant, the trimming device represented in the left-hand half of the drawing being shown in its initial position and the trimming device represented in the right-hand half of the drawing being shown in its position after the cut;

FIG. 7 shows a diagrammatic horizontal section through the trimming devices and FIG. 8 a diagrammatic top view of parts of a further exemplary embodiment of a plant according to the invention.

Figure 1:
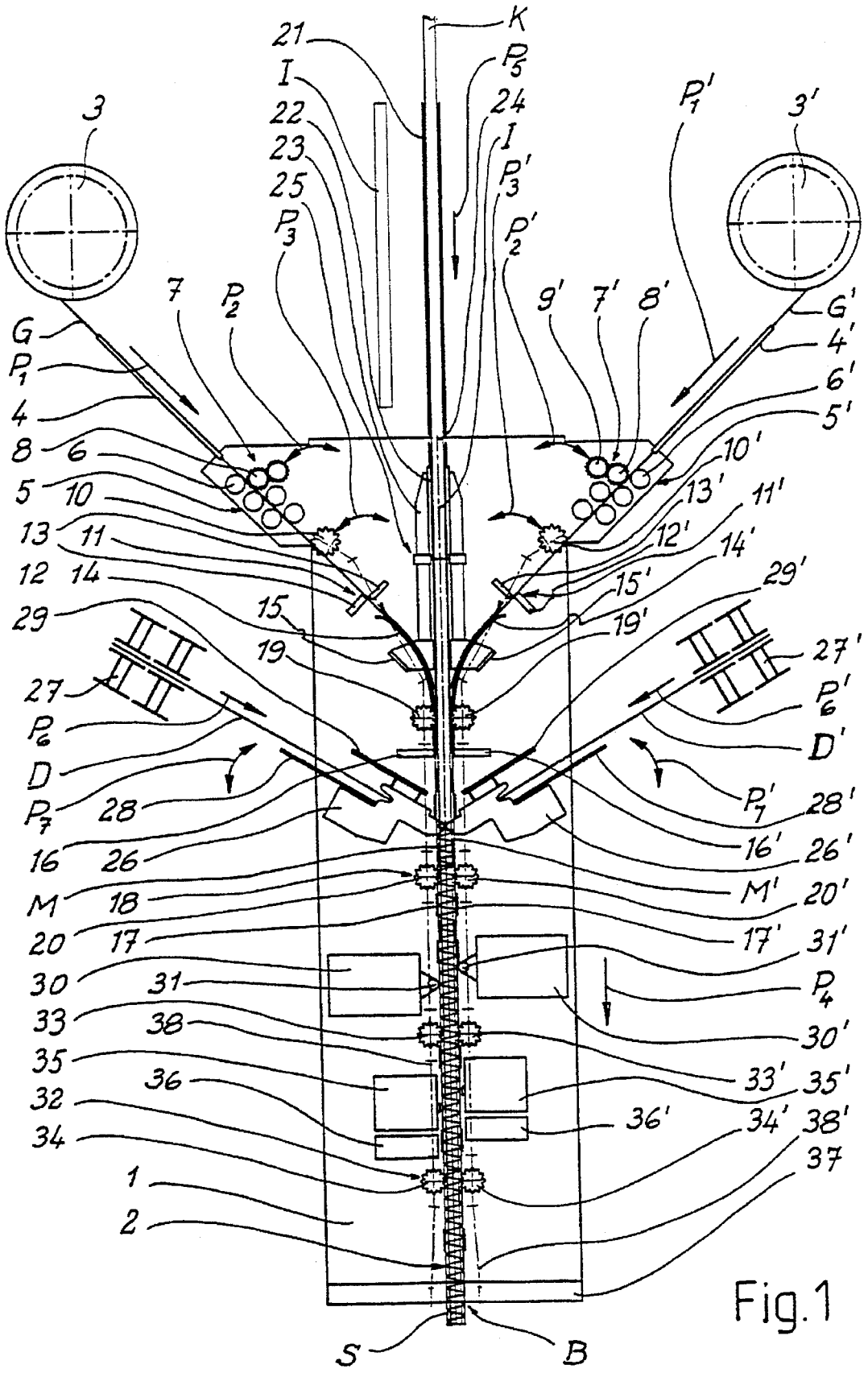
FIG. 1 shows a diagrammatic top view of a plant according to the invention.

The plant according to the invention illustrated in FIG. 1 serves for the production of a building element B consisting of two parallel flat grid meshes M, M' made from intersecting longitudinal and transverse wires L, L' and Q, Q' welded to one another at the intersection points, of straight web wires S which hold the two grid meshes M, M' at predetermined mutual spacing and which are each welded at each end to a wire of the two grid meshes M, M', and of an at least partially dimensionally stable insulating body I, for example an insulating board made of plastic, arranged between the grid meshes M, M' and with a predetermined spacing from these.

The plant has a basic frame 1, on which a horizontal production channel 2, merely indicated diagrammatically, is arranged preferably centrally. Two grid sheets G and G' standing on edge are drawn off according to the arrows P1 and P1' from two supply reels 3, 3', the mutual spacings of the longitudinal wires L; L' and of the transverse wires Q; Q' of each grid sheet G; G' relative to one another, that is to say the so-called longitudinal-wire and transverse-wire divisions, and the width of each grid sheet G; G' being freely selectable within specific ranges.

By way of a grid-sheet guide 4; 4', each grid sheet G; G' passes into a straightening device 5; 5' which consists in each case of a plurality of straightening rollers 6; 6' which are offset relative to one another and which straighten each grid sheet. Each straightening device 5; 5' has, on its entry side, a grid-sheet feeding device 7; 7' which consists in each case of a take-up roller 8; 8' and of a driving roller 9; 9' cooperating with the take-up roller 8; 8', each driving roller 9; 9' being capable of being brought by pivoting according to the double arrow P2; P2' either into or out of engagement with the take-up roller 8; 8'. The grid-sheet feeding devices 7, 7' have the function of feeding the grid sheets G, G' for further processing to downstream grid-sheet push-in devices 10, 10' in the direction of the arrows P1; P1' or of conveying grid-sheet residues no longer required after the completion of production out of the straightening devices 5, 5' in the opposite direction to the arrows P1; P1'.

Each grid-sheet push-in device 10; 10' is pivotable according to the double arrow P3; P3' between a working position, in which it is in engagement with the grid sheet G; G' to be pushed in, and a position of rest, in which it is out of engagement with the grid sheet G; G'. By means of the grid-sheet push-in devices 10, 10', the design of which is described later, the grid sheets G, G' are fed in steps to mesh shears 11, 11' which each have essentially a cutting bar 12; 12' and a knife bar 13, 13' and which sever grid meshes M, M' of predetermined length from endless grid sheets.

In the example shown, the mesh shears 11, 11' work in such a way that they execute a severing cut and consequently sever successive grid meshes M, M' continuously from the grid sheets G, G'. Within the scope of the invention, however, it is also possible to design and activate the mesh shears 11, 11' in such a way that they execute a trimming cut on the longitudinal wires and, in one or in two cutting operations, cut out from the grid sheets G, G' a selectable portion, of which the length in the direction of advance corresponds preferably to the transverse-wire division or to an integral multiple of the transverse-wire division.

By means of slightly curved lead devices 14, 14' which only elastically deform the straightened grid meshes M, M' and open tangentially on opposite longitudinal sides of the production channel 2 and which consist, for example, of a plurality of arcuate battens arranged one above the other and are fastened to the basic frame 1 by means of brackets 15, 15' and mountings 16, 16', the grid meshes M, M' are led into the production channel 2 in such a way that they come into a position parallel to one another there, with a mutual spacing which corresponds to the desired thickness of the building element B to be produced. In the production channel 2, the two grid meshes M, M' are reliably guided over their entire width and always maintained exactly at this specific spacing by means of distancing elements 17, 17', merely indicated diagrammatically, which consist, for example, of distance plates and of a plurality of distance guides arranged one above the other in the vertical direction.

By means of a grid-mesh conveying device 18 which has essentially two pairs of advancing elements 19, 19' and 20, 20' located opposite one another and arranged on both sides of the production channel 2, the two grid meshes M, M' are conveyed in steps in the lead devices 14, 14' and in the production direction P4 along the production channel 2 to the downstream processing stations. The first pair of advancing elements 19, 19' is arranged in the parallel exit region of the lead devices 14, 14'. The spacing of the first pair of advancing elements 19, 19' from the mesh shears 11, 11' and the spacing of the two pairs of advancing elements 19, 19' and 20, 20' from one another must be smaller than the smallest length of the grid meshes M, M' intended for the production of the building element B, in order to guarantee a reliable further conveyance of the grid meshes M, M' by the grid-mesh conveying device 18.

The preferably board-like individual insulating bodies I are fed by a delivery device 21 in the direction of the arrow P5 to a guide device 22 which forms the entry side of the production channel 2 and which is fastened to the basic frame 1 by means of a fastening plate 23. The guide device 22 is designed in such a way that the insulating body I is guided reliably both in the vertical direction and in its position relative to the two grid meshes M, M' and at a predetermined spacing from these. The length and width of the insulating body I are preferably identical to the length and width of the grid meshes M, M' respectively.

In the entry region of the guide device 22, the insulating bodies I are grasped by an insulating-body conveying device 24 extending over the entire length of the production channel 2 and are fed to the downstream processing stations in steps synchronously with the grid meshes M, M'.

Within the scope of the invention, it is possible to feed an insulating-body sheet K to the delivery device 21 instead of the individual insulating bodies I previously cut to length and to sever insulating bodies I of predetermined length from the sheet by means of an insulating-body cutting device 25 arranged in the exit region of the guide device 22.

On both sides of the production channel 2, the lead devices 14, 14' are each followed by a web-wire feeding and cutting device 26; 26', by means of which a plurality of wires D, D' are simultaneously drawn off in steps from both sides of the production channel 2 from wire-supply reels 27, 27' in the direction of the arrows P6, P6', are straightened in each case by means of a dressing device 28, 28', are introduced in the horizontal direction into the interspace between the two grid meshes M, M' and are pushed through the insulating body I and severed from the wire supply.

It is possible, within the scope of the invention, to arrange all the web-wire feeding and cutting devices 26, 26' successively in the production direction on one side of the production channel 2.

The insulating body I is pierced by a plurality of rows R1 and R2 each of a plurality of straight web wires S arranged one above the other in the vertical direction with a mutual spacing. The web wires S bear with their two ends in each case against the corresponding longitudinal wires L, L' of the two grid meshes M, M' and protrude slightly laterally beyond the grid meshes M, M', in order to guarantee reliable welding to the corresponding longitudinal wires L, L' of the grid meshes. In the exemplary embodiment illustrated, the web wires S within a vertical row R1 or R2 extend horizontally in the same direction obliquely relative to the grid meshes M, M'. In adjacent rows R1, R2, the web wires extend at an inclination in the opposite direction. Within the scope of the invention, it is also possible for the direction of the web wires to be the same in all the rows. As seen in the horizontal direction, the web wires S extend in the form of horizontal lines Z obliquely between opposite longitudinal wires L and L' of the grid meshes M and M'. The respective angles of the web wires S relative to the longitudinal wires L, L' are selectable, the direction of the web wires S within a line Z changing, so that a lattice work-like, zigzag-shaped arrangement of the web wires S within a line Z is obtained. In the insulating body I, therefore, a plurality of parallel horizontal lines Z of web wires S are arranged one above the other in the vertical direction, that is to say the web wires S form in the insulating body I, and consequently also in the building element B to be produced, a matrix-like structure with horizontal lines Z and vertical rows R1, R2.

The shoot-in angle, at which the web wires S are introduced into the interspace between the two grid meshes M, M', can be adjusted by pivoting the web-wire feeding and cutting devices 26, 26' according to the double arrows P7, P7'. The material and design of the insulating bodies I must be such that, during the subsequent further transport taking place in the production direction P4, the insulating bodies fix the web wires S immovably in their position within the insulating body. The number, the shoot-in angles and the mutual vertical spacings of the web wires S, arranged one above the other in the vertical direction in a row R1 or R2, as well as the horizontal spacing of the rows of web wires are selected in conformity with the static requirements placed on the building element B.

In many instances of use, it may be necessary to produce the insulating body I of the building element B from such hard materials that it cannot be pierced by the web wires S without the latter being deformed. It is possible, in this case, to use, for example, hard plastics, such as polyurethane, lightweight concrete provided with expanded or foamable polystyrene as a lightweight additive, plasterboards or cement-bound hardboards which contain plastic waste, wood shavings or wood chips, mineral or vegetable fibrous materials. Moreover, it is possible, within the scope of the invention, to construct the insulating body I in layers, and the outer covering faces of the insulating body can consist of relatively hard materials impenetrable by the web wires, such as, for example, hard plastic or wood boards, wood, jute, cane or bamboo plaiting, and the core of the insulating body I of loose soft filling material, such as, for example, foam, plastic waste, wood wool or mineral wool. In these cases, each web-wire feeding and cutting device, 26, 26' is preceded by a bradawl device 29, 29' shown diagrammatically in FIG. 1. Each bradawl device 29, 29' has a plurality of tools which are arranged one above the other in the vertical direction and which each serve for shaping out a channel in the insulating body I for receiving a web wire S in each case and are arranged on a common pivotable column. At the same time, the columns of the bradawl devices 29, 29' are fixedly coupled to the associated web-wire feeding and cutting device 26, 26' and, jointly with the latter, are movable in the direction of the insulating body I of the building element B and away from this and, jointly with the latter, are pivotable according to the double arrow P7, P7'.

It is possible, within the scope of the invention, to design the bradawl devices 29, 29' in conformity with the device described in EP-B-398,465. In this, the advancing movement of the bradawl devices 29, 29' for shaping out the receiving channel for the web wires takes place independently of the advancing movement of the web-wire feeding and cutting devices 26, 26'. Only the pivoting movement of each column of the bradawl devices 29, 29' for varying the shoot-in angles of the web wires S takes place synchronously with the pivoting movement of the respective associated web-wire feeding and cutting device 26, 26' according to the double arrows P7, P7'.

The tools for shaping out the receiving channel for the web wires S can be designed as solid pricking needles or hollow needles or also as rotating gimlets and have a wear-resistant, for example hardened tip. The pricking needles or hollow needles can preferably be preheated in their tips, in order to make it easier to pierce the insulating body I.

The two grid meshes M, M' are fed by means of the second pair of advancing elements 20, 20' of the grid-mesh conveying device 18 in steps, synchronously with the insulating body I together with the web wires S which is advanced by means of the insulating-body conveying device 24, to downstream web-wire welding devices 30, 30', in which the web wires S are welded in each case at one end to the longitudinal wires L, L' of the grid meshes by means of welding tongs 31, 31'.

The now dimensionally stable building element B is conveyed further in steps by a downstream building-element conveying device 32 which has essentially two pairs of conveying elements 33, 33' and 34, 34' located opposite one another on both sides of the production channel 2.

The projecting lengths E of the web wires S protruding laterally beyond the grid meshes M, M' constitute a considerable risk of injury during the handling of the building element B, obstruct the stacking of the building elements for transport and therefore have to be separated, so that the wires terminate as flush as possible with the longitudinal wires L, L'. By means of the first pair of conveying elements 33, 33', the building element B is fed to downstream triming devices 35, 35' which are arranged offset on opposite sides of the production channel 2 and which cut off the web-wire ends E, projecting laterally beyond the corresponding longitudinal wires L, L' of the grid mesh M, M', flush with the longitudinal wires L, L'.

Within the scope of the invention, it is possible to divide the finished triced building element B in the horizontal direction into at least two building elements, preferably of the same size, by means of cutting devices 36, 36' downstream of the trimming devices 35, 35' on both sides of the production channel 2. The cutting devices 36, 36' are designed in such a way that they can sever both the transverse wires Q, Q' of the grid meshes M, M' and the insulating body I.

It is also possible, within the scope of the invention, by means of the delivery device 21, to feed individual insulating bodies I cut to length and/or a plurality of vertically extending endless insulating-body sheets K to the guide device 22 in a plurality of tracks extending one above the other in the vertical direction.

Furthermore, it is possible, within the scope of the invention, to divide the one-piece insulating body I and/or the endless insulating body sheet K in the insulating-body cutting device 25, by means of an additional cutting tool, into at least two portions or part sheets extending one above the other in the vertical direction, so that only the transverse wires Q, Q' of the grid meshes M, M' still have to be severed in the cutting devices 36, 36'.

Moreover, according to the invention, it is possible in the insulating-body cutting device 25, during the horizontal cutting of the insulating body I or the insulating-body sheet K, not to sever this completely, but only to cut into it from both sides or even only from one side of the insulating body I of the insulating-body sheet K, such that a web connecting the two parts remains in the insulating body I. In this case, only the transverse wires Q, Q' of the grid meshes M, M' are severed in the cutting devices 36, 36' and the final division of the finished building element B into two or more building-element parts is carried out only on site by breaking open the insulating-body web.

Figure 2:
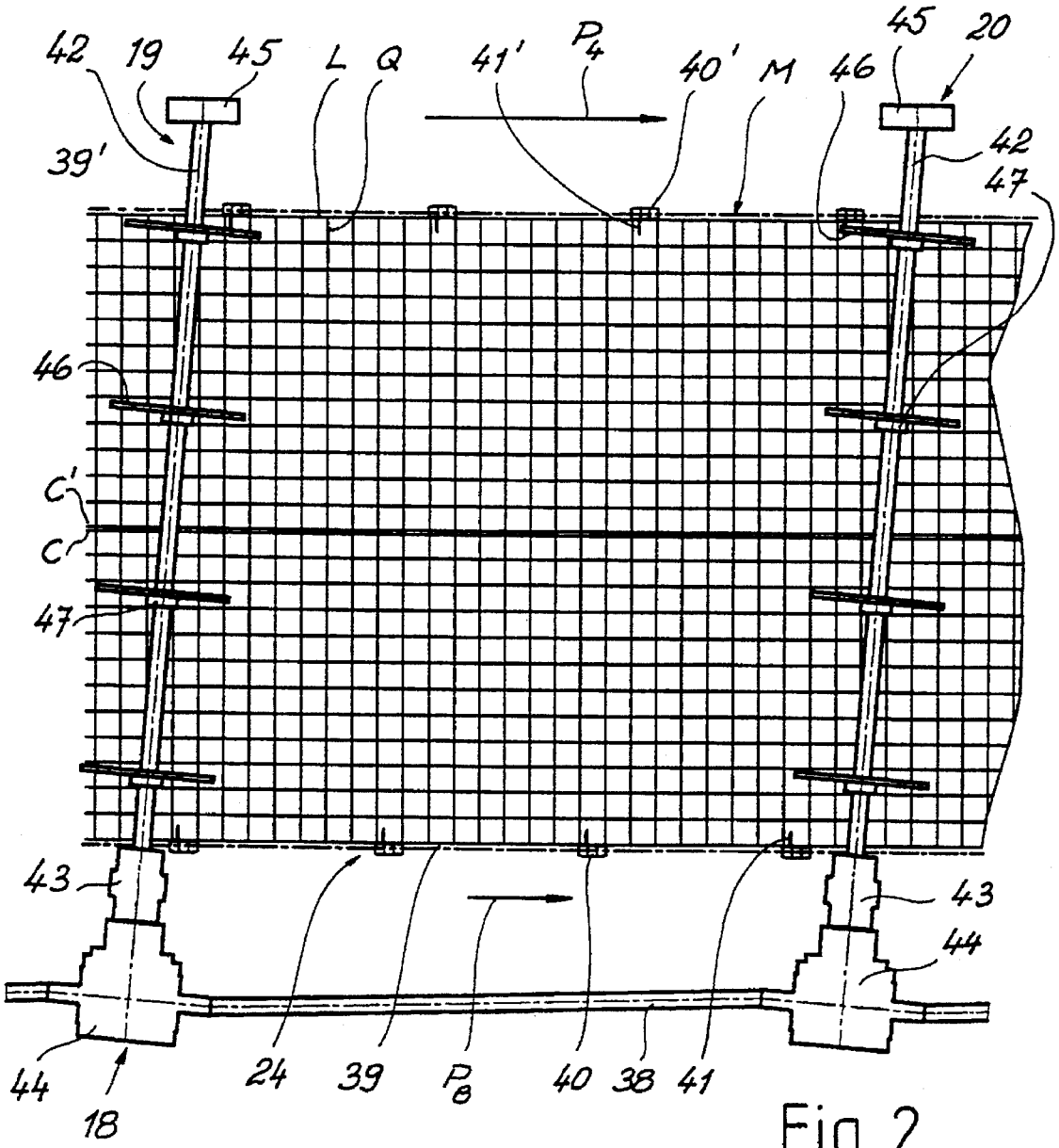
FIG. 2 shows a diagrammatic side view of a grid-mesh conveying device.

In order to keep the projecting length of transverse wire as small as possible during the severance of the building element B and to avoid a further trimming of the building-element parts, within the scope of the invention it is possible, as shown in FIG. 2, to select the spacings of the two central longitudinal wires C, C' between which the building element B is severed, correspondingly smaller than the remaining longitudinal-wire division of the grid meshes M, M'.

The finished trimmed building element B is conveyed out of the production channel 2 by means of the second pair of conveying elements 34, 34' of the building-element conveying device 32 and is transferred to devices (not shown) for transporting away or for stacking a plurality of building elements.

The spacing between the second pair of advancing elements 20, 20' of the grid-mesh conveying device 18 and the first pair of conveying elements 33, 33' of the building-element conveying device 32 as well as the spacing between the pairs of conveying elements 33, 33' and 34, 34' must always be smaller than the smallest length of the grid meshes M, M' used for producing the building element B, in order to guarantee a reliable further conveyance of the grid meshes between the grid-mesh conveying device 18 and the building-element conveying device 32 as well as through these.

For the continuous production of the building elements B, it is absolutely necessary to feed the two grid sheets G, G', the grid meshes M, M' and the insulating-body sheet K or individual insulating bodies I to the individual processing stations 11, 11'; 25; 26, 26'; 29, 29'; 30, 30'; 35, 35'; 36, 36' reliably and in a fault-free manner. In order to guarantee this, the grid-sheet push-in devices 10, 10', the pairs of advancing elements 19, 19'; 20, 20' of the grid-mesh conveying device 18, the pairs of conveying elements 33, 33'; 34, 34' of the building-element conveying device 32 and the insulating-body conveying device 24 are driven by a central main advancing drive 37, all the elements 19, 19'; 20, 20'; 33, 33'; 34, 34' end the grid-sheet push-in devices 10, 10' being connected to one another by means of articulated drive shafts 38, 38'. The advancing steps take place intermittently, because the introduction of the web wires S, the welding of the web wires S to the wires of the grid mesh M, M' and the trimming of the web-wire end parts each take place when the grid meshes, the insulating body or the building elements are stationary. At the same time, the length of the advancing steps is selectable according to the transverse-wire division or to an integral multiple of the transverse-wire division.

Building elements B having a different predetermined width can be produced by widening the production channel 2 and by a corresponding individual or joint lateral adjustment of the advancing elements 19, 19'; 20, 20', of the conveying elements 33, 33'; 34, 34' and of the elements of the processing stations 25; 26, 26'; 29, 29'; 30, 30'; 35, 35'; 36, 36'.

The insulating-body conveying device 24 shown diagrammatically in FIG. 2 has a conveyor chain 39 which is driven by the main advancing drive 37 in the direction of the arrow P8 and which defines the conveying track of the insulating bodies I within the production channel 2. The conveyor chain 39 carries a plurality of take-up carriers 40 which are each provided with a take-up dog 41. The take-up dogs 41 are made angular, hook-shaped or peg-like, in order to make a reliable connection to the underside of the insulating body I and therefore, during the advance of the insulating body, prevent any slip between the latter and the take-up carriers 40.

If the insulating bodies I are being fed in a plurality of tracks located one above the other, the insulating-body conveying device 24 has a further upper conveyor chain 39' with corresponding take-up carriers 40' and take-up dogs 41' which engage on the top side of the insulating body I of the uppermost insulating-body sheet.

The advancing elements 19, 20 of the grid-mesh conveying device 18, which are shown diagrammatically in FIG. 2, have a shaft 42 which is inclined relative to the vertical and which is driven by an angular gear 44 via a coupling 43 and is mounted in a counterbearing 45. The angular gear 44 is driven by the main advancing drive 37 (FIG. 1) via the drive shaft 38. Each shaft 42 is provided with a plurality of transport discs 46 which are arranged at a mutual adjustable spacing and which are rotatable for adjustment on the shaft 42 and, after adjustment, are fixedly connected to the shaft 42 by means of a clamping element 47.

As shown in FIG. 3*a*, the transport discs 46 have a plurality of grid-engagement recesses 48 of selectable depth which are distributed regularly over the circumference, so that flattened teeth 49 are obtained. The number of grid-engagement recesses 48 is selected according to the transverse-wire division of the grid meshes M, M', in such a way that the transverse wires Q, Q' of the grid meshes are grasped reliably by the transport discs 46 and the slip-free advance of the grid meshes is guaranteed. As a result of the inclination of the shafts 42, the transport discs 46 of each advancing element 19, 19'; 20, 20' engage not only on one, but on a plurality of transverse wires Q, Q' of the grid meshes M, M', so that the tensile force is distributed to a plurality of wires and consequently these are not loaded excessively during the advance of the grid meshes. Moreover, the inclination of the shaft 42 guarantees a continuous and slip-free further transport of the grid meshes M, M' of successive building elements B, and in the joining region the successive grid meshes can have spacings which are obtained, for example, during the trimming of the grid meshes or during the separation of portions from the grid sheets G, G'.

The conveying elements 33, 33'; 34, 34' of the building-element conveying device 32 are designed in a similar way to the advancing elements 19, 19'; 20, 20' of the grid-mesh conveying device 18. Only the transport discs 46 have grid-engagement recesses 48 of smaller depth. The grid-sheet push-in devices 10, 10' have essentially the same elements as the advancing elements 19, 20 of the grid-mesh conveying device 18 which are shown in FIG. 2. The only difference is that, as shown in FIG. 3*b*, the grid-engagement recesses 48 of the transport discs 50 are substantially deeper, so that they have pointed teeth 51. This shaping of the teeth 51 ensures that the teeth 51 engaging from the side into the non-guided grid sheet G, G' grasps the transverse wires Q of the grid sheets G, G' reliably and advance the grid sheets G, G' in a slip-free manner.

The web-wire welding devices 30, 30' shown diagrammatically in FIGS. 4 and 5 are located offset opposite one another on the outside of the two grid meshes M and M'. Each web-wire welding device, 30, 30' has a mount 52 which consists essentially of a bottom plate 53, of a cover plate 54 and of a vertical angle plate 55. The mount 52 is adjustable according to the double arrow P9 in the vertical direction, according to the double arrow P10 in the horizontal direction perpendicular to the grid meshes M, M' and according to the double arrow P11 in the horizontal direction parallel to the grid meshes. At the same time, the bottom plate 53 and the cover plate 54 are each mounted so as to be vertically and horizontally displaceable in a baseplate 57 by means of an adjusting device 56. The vertical adjustment according to the double arrow P9 takes place, for example, by means of an adjusting thread, whilst the horizontal adjustment perpendicular to the grid meshes M, M' according to the double arrow P10 is carried out, for example, by an eccentric adjusting device. Each baseplate 57 is mounted so as to be displaceable according to the double arrow P11 parallel to the grid meshes M, M' on a fixed basic frame 59 provided with a dovetail guide 58.

The bottom plate 53 is equipped with two lower bearing cheeks 60, in which a lower eccentric shaft 61 is mounted rotatably. The coverplate 54 has two upper bearing cheeks 62, in which an upper eccentric shaft 63 is mounted rotatably. The pivoting movement of the lower eccentric shaft 61 takes place by means of a drive element, for example a working cylinder, and of a pivoting lever fixedly connected to the lower eccentric shaft 61. By means of a coupling element, for example a coupling rod, between the lower eccentric shaft 61 and the upper eccentric shaft 63, the pivoting movement of the lower eccentric shaft 61 is transmitted to the upper eccentric shaft 63 in such a way that the upper eccentric shaft 63 executes a simultaneous, but opposed pivoting movement. A front vertically extending welding-tong bar 64 and a rear vertically extending welding-tong bar 65 are pivotably mounted, in each case via plain bearings or via fixed bearings, in the eccentric part 61' of the lower eccentric shaft 61 and in the eccentric part 63' of the upper eccentric shaft 63. The front welding-tong bar 64 carries a plurality of two-armed lower welding-tong levers 66 arranged at a mutual vertical spacing, and the rear welding-tong bar 65 carries a plurality of two-armed upper welding-tong levers 67 arranged at a mutual vertical spacing, each welding-tong lever 66 or 67 being mounted pivotably in a welding-tong bearing 68 according to the double arrow P12 and in an electrically insulated manner. The number of upper and lower welding-tong levers 66 and 67 corresponds at least to the number of web wires S within a vertical row of web wires R1 and R2. Each welding-tong lever 66 or 67 has, at its front end facing the grid meshes M, M', a welding electrode 69 and, at its other end, is supported via a spring element 70 in each case on a support plate 71 extending obliquely, the corresponding support plates 71 each being arranged on a vertical supporting bar 72 fixedly connected to the corresponding welding-tong bars 64; 65. The spring force and spring excursion of each spring element 70 are individually adjustable, in order to generate the necessary welding pressure and to allow the resetting of the welding electrode 69 which is necessary during the welding operation as a result of the softening of the wires S; L, L'. All the support plates 71 are electrically insulated from one another by means of insulating pieces 73. As shown in FIG. 5, two welding electrodes 69 can be arranged on each welding-tong lever 66 or 67, so that two web wires S are simultaneously welded to a longitudinal wire L or L'. The upper and lower welding-tong levers 66 and 67 cooperate respectively in pairs and form the jaws of the welding tongs 31 and 31', the welding electrodes 69 of each pair of welding tongs 31 and 31' being located congruently one above the other in the welding position. The mutual vertical spacing of the welding electrode 69 in the welding position corresponds to the vertical spacing of the web wires S within the rows of web wires R1 and R2. All the welding-tong levers 66 and 67 are electrically connected to the associated welding-tong bars 64 and 65 by means of flexible current leads.

Each welding-tong bar 64 and 65 is connected in each case via two flexible current strands 74 to the two secondary terminals 75 of a welding transformer 76, all the electrical parts being covered in a manner protected against accidental contact by means of a covering 77. However, within the scope of the invention, it is also possible, in the case of a lower power requirement, to use only one welding transformer for both welding-tong bars.

The welding device works as follows:

As a result of the rotational movement of the lower eccentric shaft 61 and as a result of the opposed rotational movement of the upper eccentric shaft 63 taking place simultaneously by virtue of the coupling element, the front welding-tong bar 64 pivots according to the double arrow P13 and the rear welding-tong bar 65 pivots in the opposite direction according to the double arrow P14 out of their initial position into the welding position and, after welding has terminated, back into the initial position again. The left-hand half of the drawing in FIG. 4 shows the welding-tong levers 66 and 67 in their initial position and the right-hand half of the drawing in FIG. 4 shows them in their welding position. In the welding position, at least the welding electrodes 69 reach into the grid-mesh plane, that is to say into the grid apertures, formed by adjacent longitudinal and transverse wires, of the grid meshes M, M', in order to grasp over a large area both the web wire S to be welded and the associated longitudinal wire L; L' of the respective grid mesh. In the initial position, the welding electrodes 69 are located outside the grid-mesh planes, so as not to obstruct the advance of the building element B.

The trimming devices 35 and 35' shown diagrammatically in FIGS. 6 and 7 each have a mount 78 which consists essentially of two vertical carrier plates 79 and which is provided with two bearing journals 80. The mount 78 is adjustable according to the double arrow P15 in the vertical direction, according to the double arrow P16 in the horizontal direction perpendicular to the side faces of the building element B and according to the double arrow P17 in the horizontal direction parallel to the side faces of the building element B.

The vertical adjustment of the mount 78 takes place by means of an adjusting thread in the bearing journals 80. Each bearing journal 80 is mounted eccentrically in a one-armed approach lever 81 which is itself mounted pivotably in a base plate 82. As a result of the pivoting of the approach lever 81, for example by means of an adjusting spindle, the horizontal adjustment of the mount 78 perpendicular to the grid meshes M, M' of the building element B according to the double arrow P16 takes place. Each base plate 82 is mounted so as to be displaceable according to the double arrow P17 parallel to the grid meshes M, M' on a basic frame 84 provided with a dovetail guide 83.

A lower eccentric shaft 85 and an upper eccentric shaft 86 are mounted rotatably in the two carrier plates 79, the pivoting movement of the lower eccentric shaft 85 taking place by means of a drive element, for example a working cylinder, and of a pivoting lever connected fixedly to the lower eccentric shaft 85. By means of a coupling element, for example, a coupling rod, connecting the lower eccentric shaft 85 to the upper eccentric shaft 86, the pivoting movement of the lower eccentric shaft 85 is transmitted to the upper eccentric shaft 86 in such a way that the upper eccentric shaft 86 executes a simultaneous, but opposed pivoting movement.

In the eccentric part 85' of the lower eccentric shaft 85 and in the eccentric part 86' of the upper eccentric shaft 86, two vertically extending cutting bars 87 arranged at a mutual spacing are mounted pivotably, in each case via fixed bearings and via plain bearings, and a knife bar 88 extending between the two cutting bars 87 is mounted pivotably, in each case via plain bearings or via fixed bearings. The cutting bars 87 jointly carry, on their sides facing the building element B, a row of upper knives 89 arranged one above the other at an adjustable mutual spacing, and the knife bar 88 carries, on its side facing the building element B, a row of lower knives 90 arranged one above the other at an adjustable mutual spacing.

The number of upper knives 89 and of lower knives 90 corresponds at least to the number of lines Z of web wires to be trimmed. The mutual spacing of the upper knives 89 and of the lower knives 90 relative to one another corresponds to the spacing of the lines Z of web wires to be trimmed. As a result of the coupled pivoting movements of the two eccentric shafts 85 and 86, the cutting bars 87 execute a pivoting movement according to the double arrow P18 and the knife bar 88 executes an opposed pivoting movement according to the double arrow P19.

FIG. 6 shows the trimming device 35' in the initial position and the trimming device 35 in the working position. The trimming devices 35, 35' work as follows: As a result of the rotational movement of the lower eccentric shaft 85 and as a result of the opposed rotational movement of the upper eccentric shaft 86 taking place simultaneously by virtue of the coupling element, the cutting bars 87 pivot according to the double arrow P18 and the knife bar 88 pivots in the opposite direction according to the double arrow P19 out of their initial position into the cutting position and, after the projecting lengths E of web wire have been severed, back into the initial position again.

It is also possible, within the scope of the invention, to mount the cutting bars 87 and the knife bar 88 in each case on two separate eccentric shafts and to pivot the cutting bars 87 and the knife bar 88 in each case separately by means of a working cylinder acting on the respective eccentric shaft. At the same time, the pivoting movement of the knife bar 88 takes place independently of the pivoting movement of the cutting bars 87, in each case in the opposite direction to the pivoting movement of the cutting bars 87.

Furthermore, within the scope of the invention, it is possible to design the upper knives 89 and lower knives 90 and activate the cutting bars 87 having the upper knives 89 and the knife bar 88 having the lower knives 90 in such a way that, during the cutting operation, each upper knife 89 serves as an abutment for fixing the longitudinal wire L, L', to which the web wire S to be trimmed is welded, whilst the associated lower knife 90 acts as a cutting tool for severing the projecting length E of web wire and shears off the projecting length E of web wire in the direction of the longitudinal wire L, L' retained by the upper knife 89.

The cycles of movement of the welding-tong bars 64, 65 of the web-wire welding device 30, 30' as well as of the cutting bars 87 and knife bar 88 of the trimming devices 33, 35' must be coordinated exactly with one another, in order, on the one hand, not to deform the longitudinal wires L, L' of the grid meshes M, M' or the building element B during the welding of the web wires S to the longitudinal wires L, L' and during the trimming of the web wires S and, on the other hand, to position correctly the welding tongs 31, 31' or the upper and lower knives 89; 90 for welding the web wires S to the longitudinal wires L, L' or for severing the projecting lengths E of web wire. For this reason, there are automatic measuring and control devices (not shown) which monitor and control the individual equipment of the web-wire welding devices 30, 30' and of the trimming devices 35, 35' and their cycles of movement.

In order to increase the productivity of the plant and avoid interrupting the continuous production flow, a further exemplary embodiment of a plant according to the invention, as shown in a partial top view in FIG. 8, has, in each case, two supply reels 91, 91' and 92, 92' for grid sheets G1, G1' and G2, G2', grid sheets G1, G1' or G2, G2' being fed in the direction of the arrows P20, P20' and P21, P21' from one pair of associated supply reels 91, 91' or 92, 92' to the downstream mesh shears 11, 11', whilst the other pair of associated supply reels 92, 92' or 91, 91' in readiness. Each supply reel 91, 91' or 92, 92' is followed by grid-sheet guides 93, 93' and 94, 94' and by straightening devices 95, 95' and 96, 96'. Each straightening device 95, 95' and 96, 96' has a feed device 97, 97' and 98, 98', in each case with a driving roller 99, 99' and 100, 100' pivotable according to the double arrows P22, P22' and P23, P23'. In this exemplary embodiment, the grid-sheet push-in devices 10, 10' must have a pivoting range which can cover both grid sheets G1, G1' and G2, G2'.

It goes without saying that the exemplary embodiments described can be variously modified within the scope of the general inventive idea, and in particular the two grid meshes M, M' can have a different design, that is to say different longitudinal-wire divisions and/or transverse-wire divisions as well as different diameters of the longitudinal wires and/or transverse wires. However, the various transverse-wire divisions must correspond to integral multiples and can amount, for example to 50, 100, 150 mm. A further restriction is that it is necessary to guarantee that the web wires S can be positioned in such a way that, despite these different wire divisions and wire diameters, they can be welded reliably to the longitudinal wires of the two grid meshes M, M'.

Within the scope of the invention, it is possible to feed grid meshes M, M' already cut to length to the push-devices 10, 10' instead of the grid sheets G, G'; G1, G1'; G2, G2', in this case the mesh shears 11, 11' being inoperative.

It is possible, furthermore, to produce building elements B, in which one and/or both grid meshes M, M' project beyond the insulating body I on one side or on both sides extending parallel to the production direction P4. In order to achieve this, either the take-up dogs 41 are raised or lengthened, or the conveying track of the conveyor chain 39 is raised, in such a way that the lower side face, extending parallel to the production direction P4, of the insulating body I is raised correspondingly, with the result that one and/or both grid meshes form the desired projecting length on this side.

The conveying track of the upper conveyor chain 39' arranged on the top side of the insulating bodies I must be lowered correspondingly or the take-up dogs 41' lowered or lengthened correspondingly.

To produce building elements B, in which the insulating bodies I project beyond the two grid meshes M, M' on one side or on both sides extending parallel to the production direction P4, the conveying track of the lower conveyor chain 39 is lowered and, if appropriate, the conveying track of the upper conveyor chain 39' raised, in such a way that the lower And, if appropriate, the upper side face, extending parallel to the production direction P4, of the insulating body I is lowered or raised correspondingly, with the result that the insulating body I projects beyond the two grid meshes M, M' with the desired projecting lengths on one or on both sides.

The continuous production of the building elements B by means of the plant according to the invention preferably takes place in such a way that the grid meshes M, M' of successive building elements B are separated from one another only by a negligibly narrow separating gap between the longitudinal wires of successive grid meshes M, M' and also the correspondingly associated insulating bodies I of successive building elements B follow one another without appreciable gaps.

Within the scope of the invention, however, it is also possible to produce building elements B, in which one and/or both grid meshes M, M' project beyond the insulating body I on one or on both sides extending perpendicularly to the production direction P4. If one or both grid meshes M, M' are to project beyond the insulating body I on both sides, the insulating bodies I of adjacent building elements B are fed to the production channel 2 at correspondingly selected spacings by the delivery device 21 and are advanced there with these mutual spacings. If an endless insulating-bodysheet K is used, a portion corresponding to this spacing must be separated from the sheet K when the insulating bodies I are being severed. The two separating gaps between the grid meshes M, M' of successive building elements B are located either exactly opposite one another or are offset laterally to one another.

To produce building elements B, in which the insulating bodies I project beyond the two grid meshes M, M' on one or on both sides extending perpendicularly to the production direction P4, the grid meshes are advanced at predetermined spacing in the production channel 2. To produce this selectable spacing between the grid meshes M, M' of successive building elements B, a portion corresponding to this spacing is cut out from the endless grid sheets G, G' by the mesh shears 11, 11' while the grid meshes are being made. The size of the spacing is limited by the need to ensure that the gaps between the grid meshes M, M' of successive building elements B can be bridged by the inclined shafts 42 of the grid-mesh conveying device 18 and of the building-element conveying device 32, in order to guarantee a slip-free advance of the grid meshes of successive building elements B.

Within the scope of the invention, in the case of large spacings between adjacent rows of web wires R1 and R2, two or more web-wire welding devices 30 and 30' for each side face can also be arranged in succession, as seen in the direction of advance P4 of the grid meshes M, M'. At the same time, the welding-tong levers 66 and 67 and the welding electrode 69 are designed in such a way that only one web wire S is welded to a corresponding longitudinal wire L, L' by each pair of welding tongs 31, 31'.

In order to increase the production speed, moreover, within the scope of the invention a plurality of trimming devices can be arranged in succession in the horizontal direction on each side face of the building element.

We claim:

1. Plant for the continuous production of building elements which consist of two parallel flat grid meshes made from intersecting longitudinal and transverse wires welded to one another at the intersection points, of straight web wires holding the grid meshes at a predetermined mutual spacing and of an insulating body which is arranged between the grid meshes and through which the web wires penetrate, with a production channel, with two supply reels, arranged on both sides of the production channel, and downstream straightening devices, each for a grid sheet, with two curved lead devices opening tangentially on opposite longitudinal sides of the production channel, with an insulating-body guide device arranged between the two lead devices, with at least one group, arranged laterally of the production channel, of web-wire supply reels and web-wire feeding and cutting devices, with web-wire welding devices which are arranged on both sides of the production channel and which have a transformer and flexible electrical leads from the secondary outputs of the transformer to jaws of welding tongs pivotable into the grid-mesh planes, and with web-wire trimming devices, each for severing a projecting length of web wire, characterized in that a push-in device (7, 7') for drawing off in steps an endless grid sheet (G, G'; G1, G1'; G2, G2') standing on edge from at least one supply reel (3, 3'; 91, 91'; 92, 92') and for introducing the grid sheet into the lead devices (14, 14') is arranged on each of the two sides of the production channel (2), in that two cutting devices (11, 11') for severing grid meshes (M, M') of predetermined length from the endless grid sheets (G, G'; G1, G1'; G2, G2') are provided upstream of the lead devices (14, 14'), the grid meshes (M, M') being capable of being advanced in steps in the lead devices (14, 14') and in the production channel (2) by means of a grid-mesh conveying device (18), in that an insulating-body conveying device (24) extending over the insulating-body guide device (22) and the production channel (2) is provided for advancing in steps, synchronously with the grid meshes (M, M'), at least partially dimensionally stable insulating bodies (I) intended for fixing the web wires (S), in that the feeding and cutting devices (36, 36') for equipping the insulating body (I) with web wires (S) and downstream welding devices (29, 29') for the simultaneous welding of the two ends of all the web wires (S) to corresponding longitudinal wires (L, L') of the grid meshes (M, M') are provided in the effective range of the grid-mesh conveying device (18), in that, by means of a building-element conveying device (32), the building elements (B) can in steps and successively be fed to the web-wire trimming devices (35, 35') and be conveyed out of the production channel (2), and in that the push-in devices (7, 7') and all the conveying devices (18, 24, 32), coupled to one another, can be driven jointly by means of drive shafts (38, 38').

2. Plant according to claim 1, characterized in that the length of the advancing steps of the grid-sheet push-in devices (10, 10'), of the grid-mesh conveying device (18), of the building-element conveying device (32) and of the insulating-body conveying device (24) corresponds to the smallest spacing of the transverse wires (Q, Q') of the grid meshes (M, M') or to an integral multiple of this spacing.

3. Plant according to claim 1, characterized in that the grid-sheet push-in device (10, 10'), the grid-mesh conveying device (18), the building-element conveying device (32) and the insulating-body conveying device (24) can be driven synchronously by a joint main advancing drive (37).

4. Plant according to claim 1, characterized in that a delivery device (21) is provided for the at least single-track feed of insulating bodies (I) cut to length and/or of an endless insulating-body sheet (K) into the guide device (22) and, in the exit region of the guide device (22), a cutting device (25) is provided for severing insulating bodies (I) of predetermined length from the insulating-body sheet (K).

5. Plant according to claim 1, characterized in that the insulating bodies (I) and/or the grid meshes (M, M') of successive building elements (B) can be advanced with predetermined spacings along the production channel (2), the insulating bodies (I) being capable of being introduced with predetermined spacing into the production channel (2) by means of a delivery device (21) or portions of predetermined length capable of being separated from the insulating-body sheet (K) by means of the cutting device (25) during the severance of the insulating bodies (I), and in that portions of predetermined length can be cut out from the grid sheets (G, G'; G1, G1'; G2, G2') by means of the cutting devices (11, 11') while the grid meshes (M, M') are being severed from the endless grid sheets (G, G'; G1, G1'; G2, G2').

6. Plant according to claim 1, characterized in that the grid-mesh conveying devices (18) and the building-element conveying device (31) each have at least two pairs of advancing elements (19, 19'; 20, 20') or conveying elements (33, 33'; 34, 34'), the individual elements of all the pairs being located opposite one another on both sides of the production channel (2).

7. Plant according to claim 6, characterized in that each advancing element (19, 19'; 20, 20'), each conveying element (33, 33'; 34, 34') and each grid-sheet push-in device (10, 10') has a shaft (42) inclined relative to the vertical direction and having at least two transport discs (46, 50) provided with a plurality of grid-engagement recesses (48).

8. Plant according to claim 3, characterized in that the insulating-body conveying device (24) has at least one conveyor chain (39, 39') which can be driven by the main advancing drive (37) and extends over the entire length of the production channel (2) and which has a plurality of take-up dogs (41, 41').

9. Plant according to claim 8, characterized in that the conveying track of the conveyor chain (39, 39') or the take-up dogs (41, 41') can be raised and lowered.

10. Plant according to claim 1, characterized in that the grid-sheet push-in devices (10, 10') are pivotable into the advancing track of the grid sheets (G, G'; G1, G1'; G2, G2').

11. Plant according to claim 1, characterized in that the straightening devices (5, 5'; 95, 95'; 96, 96') each have a grid-sheet feed device (7, 7'; 97, 97'; 98, 98') with a driving roller (9, 9'; 99, 99'; 100, 100') each driving roller being pivotable into the advancing tracks of the grid sheets (G, G'; G1, G1'; G2, G2').

12. Plant according to claim 1, characterized in that the web-wire feeding and cutting devices (26, 26') are pivotable in order to vary the shoot-in angles of the web wires (S).

13. Plant according to claim 1, characterized in that a web-wire feeding and cutting device (26, 26') is arranged on each of the two sides of the production channel (2).

14. Plant according to claim 1, characterized in that each web-wire feeding and cutting device (26, 26') is preceded by a bradawl device (29, 29') for shaping channels in the insulating body (I) for receiving web wires (S), these bradawl devices (29, 29') being movable in the direction of the insulating body (I) and away from this and being pivotable synchronously with the web-wire feeding and cutting devices (26, 26') in order to vary the shoot-in angles of the web wires (S).

15. Plant according to claim 14, characterized in that the bradawl devices (29, 29') for forming the receiving channel have a pricking tool with a heatable tip.

16. Plant according to claim 1, characterized in that, for each side face of the building element (B) to be produced, at least one welding device (30, 30') provided with a plurality of welding tongs (31, 31') is provided for simultaneously welding, in each case, one end of a plurality of straight web wires (S), arranged one above the other at a mutual spacing in at least one row (R1, R2), to the horizontally extending longitudinal wires (L, L') of a grid mesh (M; M'), the welding tongs (31, 31') being designed as two-armed pivotable lower and upper welding-tong levers (66; 67) which cooperate in pairs and of which the ends facing the grid meshes (M, M') and pivotable into the grid-mesh planes have welding electrodes (69) for welding at least one web wire (S) to a longitudinal wire (L; L') of the grid mesh (M; M').

17. Plant according to claim 16, characterized in that all the lower welding-tong levers (66) are arranged on a pivotable vertical front welding-tong bar (64) and all the upper welding-tong levers (67) on a pivotable vertical rear welding-tong bar (65).

18. Plant according to claim 17, characterized in that the front welding-tong bar (64) and the rear welding-tong bar (65), driven by a drive element and connected by means of a coupling element, are pivotable simultaneously, but in opposition.

19. Plant according to claim 17, characterized in that each welding-tong lever (66, 67) is supported on the associated welding-tong bar (64; 65) by means of a spring element (70) having an adjustable spring force and adjustable spring excursion.

20. Plant according to claim 16, characterized in that each welding device (30, 30') is adjustable perpendicularly and parallel relative to the side faces of the building element (B).

21. Plant according to claim 1, characterized in that at least one trimming device (35, 35') for simultaneously severing at least two adjacent projecting lengths (E) of web wire, which has at least one pivotable upper knife (39) and a pivotable lower knife (90) cooperating with the latter, is provided for each side face of the building element (B).

22. Plant according to claim 21, characterized in that an associated upper knife (89) and an associated lower knife (90) are provided for each horizontal line (Z) of web wires (S) which is provided in the building element (B).

23. Plant according to claim 21, in that all the upper knives (89) of a trimming device (35, 35') are arranged on at least one pivotable cutting bar (87) and 811 the lower knives (90) of a trimming device (35, 35') are arranged on a pivotable knife bar (88).

24. Plant according to claim 21, characterized in that the cutting bar (87) and the knife bar (88), driven by a drive element and connected by means of a coupling element, are pivotable simultaneously, but in opposition.

25. Plant according to claim 21, characterized in that 811 the upper knives (89) of a trimming device (35, 35') are fastened on at least one cutting bar (87) pivotable by means of at least one drive element and all the lower knives (90) of a trimming device (35, 35') are fastened on a knife bar (88) pivotable by means of at least one further drive element, the knife bar (88) executing a pivoting movement opposed to the pivoting movement of the cutting bar or cutting bars (87).

26. Plant according to claim 25, characterized in that each upper knife (89) forms at the same time an abutment for the associated longitudinal wire (L, L') and is pivotable in its working position by means of the cutting bar or cutting bars (87) in order to fix the associated longitudinal wire (L, L'), and each lower knife (90) can subsequently be actuated by means of the knife bar (88) in order to sever the projecting lengths (E) of web wire.

27. Plant according to claim 21, characterized in that the cutting bar or cutting bars (87) and the knife bar (88) of each trimming device (35, 35') extends in each case perpendicularly to the longitudinal wires (L, L') to which the web wires (S) are welded.

28. Plant according to claim 21, characterized in that each trimming device (35, 35') can be adjusted perpendicularly and parallel relative to the side faces of the building element (B).

29. Plant according to claim 1, characterized in that the trimming devices (35, 35') are followed, at least on one side of the production channel (2), by a cutting device (36, 36') for the horizontal division of the building element (B) into at least two portions preferably of the same size.

30. Plant according to claim 1, characterized in that the insulating-body cutting device (25) has at least one cutting tool for severing the insulating body (I) and/or the endless insulating-body sheet (K) into at least two portions and/or part sheets arranged one above the other in the vertical direction.

31. Plant according to claim 1, characterized in that, in order to adjust the width of the building element (B) to be produced, at least the devices (14', 15', 16', 17', 19', 20', 26', 29, 30', 33', 34', 35', 36', 38') arranged on one side of the production channel (2) are displaceable relative to the devices (14, 15, 16, 17, 19, 20, 26, 29, 30, 33, 34, 35, 36, 38) arranged on the other side of the production channel (2).

* * * * *

UNITED STATES PATENT AND TRADEMARK OFFICE

CERTIFICATE OF CORRECTION

PATENT NO. : 5,647,110
DATED : July 15, 1997
INVENTOR(S) : RITTER ET AL.

It is certified that error appears in the above-identified patent and that said Letters Patent is hereby corrected as shown below:

Column 17:

line 11 (claim 23), before "in", insert --characterized--.

line 13 (claim 23), "811" should be --all--.

line 20 (claim 25), "811" should be --all--.

Signed and Sealed this

Tenth Day of February, 1998

*Attest:*

*Attesting Officer*

Bruce Lehman

BRUCE LEHMAN

*Commissioner of Patents and Trademarks*